United States Patent [19]

Hayakawa

[11] 4,025,777

[45] May 24, 1977

[54] CLINICAL ILLUMINATION APPARATUS

[75] Inventor: Yoshito Hayakawa, Kounosu, Japan

[73] Assignee: Yamada Iryo Shomei Kabushiki Kaisha, Tokyo, Japan

[22] Filed: Jan. 23, 1975

[21] Appl. No.: 543,771

[30] Foreign Application Priority Data

Dec. 2, 1974 Japan ..... 49-137034

[52] U.S. Cl. ..... 240/1.4; 240/41.15

[51] Int. Cl.[2] ..... F21V 33/00

[58] Field of Search ..... 240/1.4, 41.15

[56] References Cited

UNITED STATES PATENTS

| | | | |
|---|---|---|---|
| 2,758,196 | 8/1956 | Greppin | 240/1.4 X |
| 3,378,678 | 4/1968 | Groff | 240/1.3 |
| 3,569,690 | 3/1971 | Nelson | 240/57 X |
| 3,887,801 | 6/1975 | Ilzig et al. | 240/1.4 |

FOREIGN PATENTS OR APPLICATIONS

| | | | |
|---|---|---|---|
| 847,131 | 8/1952 | Germany | 240/1.4 |
| 1,003,416 | 9/1965 | United Kingdom | 240/1.4 |

*Primary Examiner*—Richard L. Moses

*Attorney, Agent, or Firm*—Wenderoth, Lind & Ponack

[57] ABSTRACT

The present invention relates to an apparatus for clinical illumination of an operating room with a number of lamps, which are equally focused on the affected part of a patient's body, characterized in that the horizontal direction on the depth of the light focus from each lamp can be desirably changed by a single manipulation of a simple mechanism without scattering the light from each lamp.

11 Claims, 9 Drawing Figures z
x 11
12
Q
9
10
16
2
2
7
5
5
1
1
4
6
P1
O
L
13
15
15
7
8
3
14

CLINICAL ILLUMINATION APPARATUS

BACKGROUND OF THE INVENTION

Clinical illumination devices, especially those using a multi-lamp fixture, should desirably fill the following conditions:

a. All the lamps can be equally focused on the surface to be illuminated, thereby enhancing the illuminating effect.

b. A horizontal shift or a depth change of the lamp light focus is permitted so that the necessary part of a patient's body lying on the operating table can be well illuminated.

c. The foci of all lamps can be shifted in a well-set condition so that their shift can be clearly traced in changing their horizontal position or depth.

d. The illuminating fixture is not moved above the operating table so that the patient on the table can be protected from secondary infection with microbes originating from dust which naturally collects on or adheres to the lamp case and drops onto the patient's body when the lamp case is moved.

e. The above mentioned well-set condition of the lamp foci is not disturbed even after long use.

f. The illuminating fixture is a simple one which can be readily installed on the ceiling of an existing operating room without any major modification, that is, one with high availability of space.

g. The illuminating fixture is so simple in construction that it can be conveniently maintained, inspected or repaired.

Of these conditions, (a) to (d) have been variously filled separately, but in no method or fixture all of the conditions (a) to (d) have been filled at the same time. To the best knowledge of the present inventor, there exists not any method or fixture that can fill all of the conditions (a) to (g).

SUMMARY OF THE INVENTION

The present invention has been accomplished through the inventor's strenuous efforts in experimental studies to meet all the above requirements in one illumination device.

The main object of the present invention is to provide a multi-lamp clinical illumination device, whereby a well-set focal condition is not disturbed during long use and such well-set focal condition can be shifted horizontally or vertically over an operating table and the like.

Another object of the present invention is to provide a clinical illumination device, whereby the illuminating fixture is not moved through the room but shifted within a limited space, thereby preventing dust from dropping onto the operating table.

Still another object of the present invention is to provide a clinical illumination device, whereby the illuminating fixture gives high availability of space; is simplified in construction; and is extremely convenient for maintenance, inspection or repair.

To attain these objects of the present invention, a plurality of lamps appropriately arranged on the lamp fixture in the same plane are equally focused to a desired depth. Each lamp at an angle with the focus thus well set is angle-adjustably and extendably attached to a driver fitted to a plane parallel to the lamp-fitting plane. The horizontal direction or depth of the lamp focus can be desirably changed by shifting either the driver or the lamp fixture in a desired horizontal or vertical direction.

BRIEF DESCRIPTION OF THE DRAWINS

The clinical illumination device according to the present invention will become apparent by reading the following detailed description of its preferred embodiments with reference to the attached drawings, in which.

DETAILED DESCRIPTION OF PREFERRED EMBODIMENTS

Prior to a description of preferred embodiments of the present invention, its working principle will be described with reference to FIGS. 1 through 4.

Figure 1:
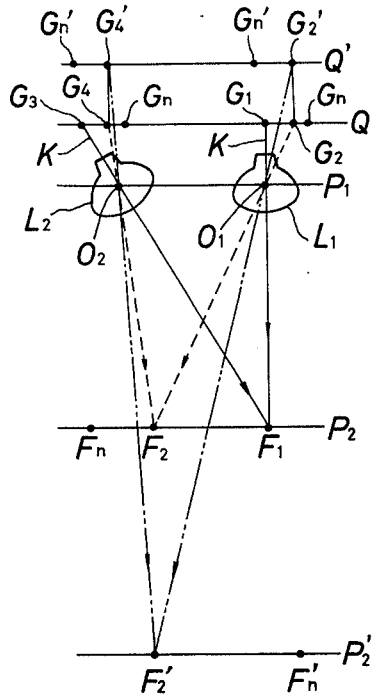
FIGS. 1 to 4 are schematic views illustrating the working principle of the present invention, FIG. 1 being an elevation view of a two-lamp fixture, and FIGS. 2 to 4 being respectively a plan view, an elevation view and a right side view of a six-lamp fixture.

In FIG. 1, the tilting axes $O_1$ and $O_2$ of the lamps $L_1$ and $L_2$ are positioned in the plane $P_1$. An extendable crank K is provided to tilt the lamps $L_1$ and $L_2$, the crank-driving points being set at $G_1, G_2, G_3, G_4, \ldots G_n$, $G_2', G_4' \ldots G_n'$. The planes containing the driving point groups G and G' are designated respectively Q and Q'. All of the planes Q, Q', $P_2$, $P_2'$ are parallel to one another. The plane $P_1$, and the tilting axes $O_1$, $O_2$ contained therein are immovable.

The light axes of the lamps $L_1$, and $L_2$ are in perfect alignment with $O_1F_1$ and $O_2$ $F_1$, i.e., extensions of the lines $O_1G_1$ and $O_2G_3$, while $O_1F_1$ and $O_2F_1$ meet together at the focus $F_1$. Then the driving points of the crank K are located at $G_1$ and $G_3$. As the driving points move from G to $G_1 \rightarrow G_2 \rightarrow G_2'$ or to $G_3 \rightarrow G_4 \rightarrow G_4'$, correspondingly the focus shifts from F to $F_1 \rightarrow F_2 \rightarrow F_2'$.

However, the driving points $G_1$ and $G_3$ corresponding to the focus $F_1$ are always interlocked on the planes Q and Q' parallel to the plane $P_1$, moving together in the same direction at the same speed. These are the preset conditions.

Now between $\Delta O_1G_1G_2$, $\Delta O_2G_3G_4$, $\Delta O_1F_1F_2$ and $\Delta O_2F_1F_2$, the following relations hold;

$$\Delta O_1G_1G_2 \backsim \Delta O_1F_1F_2$$
$$\Delta O_2G_3G_4 \backsim \Delta O_2F_1F_2 \text{ and}$$
$$\Delta O_1G_1G_2 = \Delta O_2G_3G_4$$

From the present condition of $G_1G_2 = G_3G_4$, $$\text{Line } F_1F_2 \text{ in } \Delta O_1F_1F_2 = \text{line } F_1F_2 \text{ in } \Delta O_2F_1F_2$$

and these two lines perfectly overlap each other.

Meanwhile, since the ratio of $G_1G_2 : F_1F_2$ and the ratio of $G_3G_4 : F_1F_2$ are the same and constant, the two lines $O_1F_2$ and $O_2F_2$ meet together at a position Fn corresponding $F_2$, regardless of the distance and direction of $G_1G_2$ and $G_3G_4$.

Next, between $\Delta O_1G_2G_2'$, $\Delta O_1F_2F_2'$, $\Delta O_2G_4G_4'$ and $\Delta O_2F_2F_2'$, the following relations hold:

$$\Delta O_1G_2G_2' \backsim \Delta O_1F_2F_2' \text{ and}$$
$$\Delta O_2G_4G_4' \backsim \Delta O_2F_2F_2'$$

thus, in the former $$G_2G_2' : F_2F_2' = (\text{distance } P_1Q') : (\text{distance } P_1P_2')$$

and in the latter $$G_4G_4' : F_2F_2' = (\text{distance } P_1Q') : (\text{distance } P_1P_2')$$

therefore line $F_2F_2'$ in $\Delta O_2F_2F_2'$ = line $F_2F_2'$ in $\Delta O_1F_2F_2'$, and the two lines are in perfect agreement.

Now the necessary and sufficient conditions for the focus $F_1$ to shift to $F_2$ and $F_2'$ which are arbitrary points are: on the planes Q and Q', $G_1G_2 = G_3G_4$ and $G_2G_2' = G_4G_4'$.

This means that $G_1 \rightarrow G_2 \rightarrow G_2'$ and $G_3 \rightarrow G_4 \rightarrow G_4'$ be interlocked to take place at the same time in the same direction at the same speed, while the driving points $G_1$ and $G_3$ be shifted respectively as $G_1 \rightarrow G_2 \rightarrow G_2'$ and $G_3 \rightarrow G_4 \rightarrow G_4'$.

Figure 2:
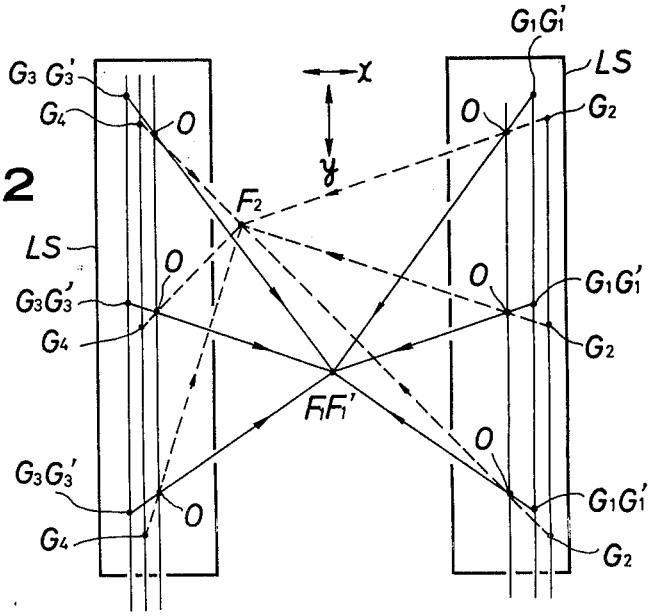
Figure 3:
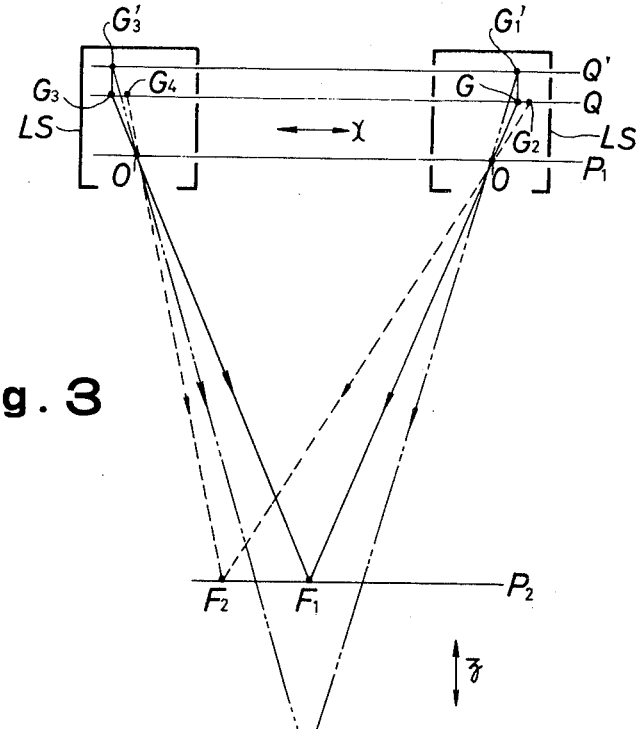
Figure 4:
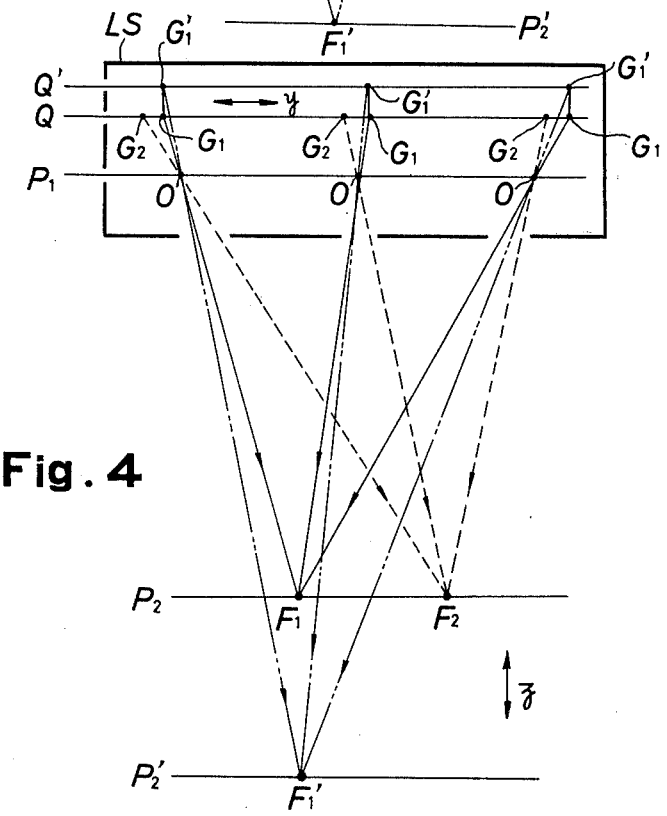

This principle will be three-dimensionally valid as shown in FIGS. 2 to 4, even if the structure in FIG. 1 is three-dimensionalized and set up on a longitudinal plane.

In the figures LS represents the illuminating fixture.

Also it is self-evident that the same principle holds, even if the driving points $G_1$, $G_3$ on the plane Q in FIG. 1 are fixed and the tilting axes $O_1$, $O_2$ on the plane $P_1$ are movable on the plane $P_1$ longitudinally, transversely or vertically.

Figure 5:
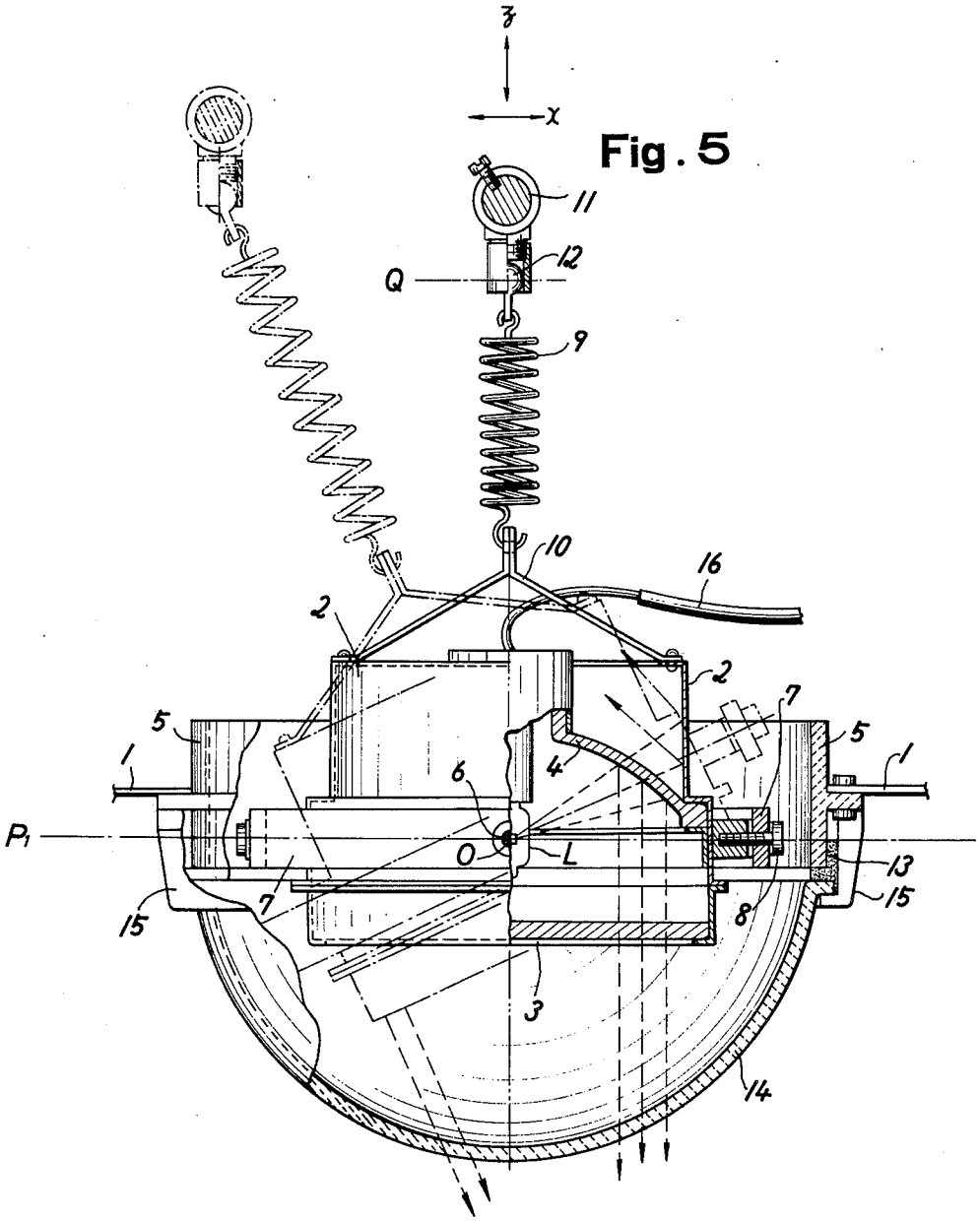
FIG. 5 illustrates a lamp assembly according to the described principle of the present invention.
Figure 6:
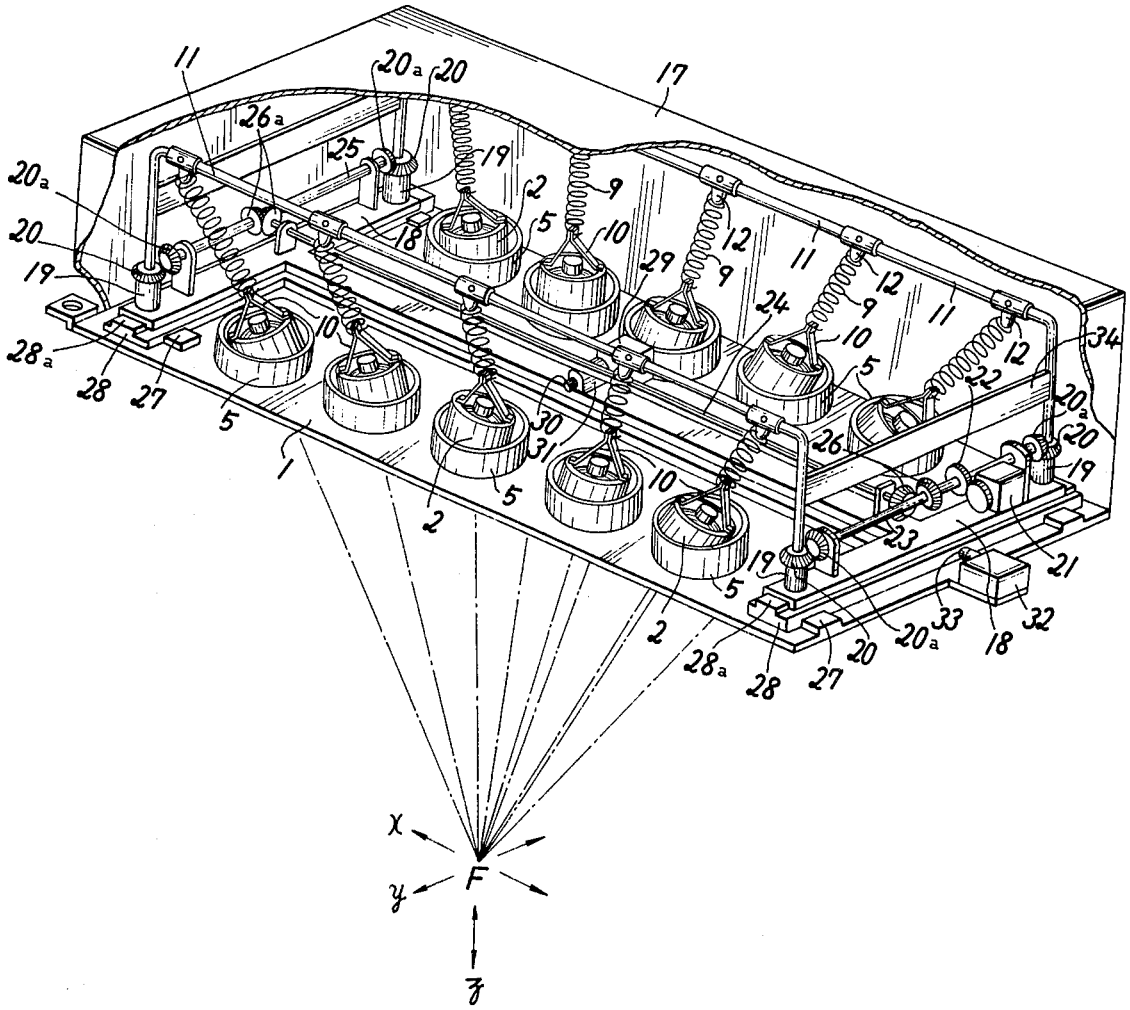
FIGS. 6 to 9 are partially cutaway perspective views of several embodiments of the present invention.
Figure 7:
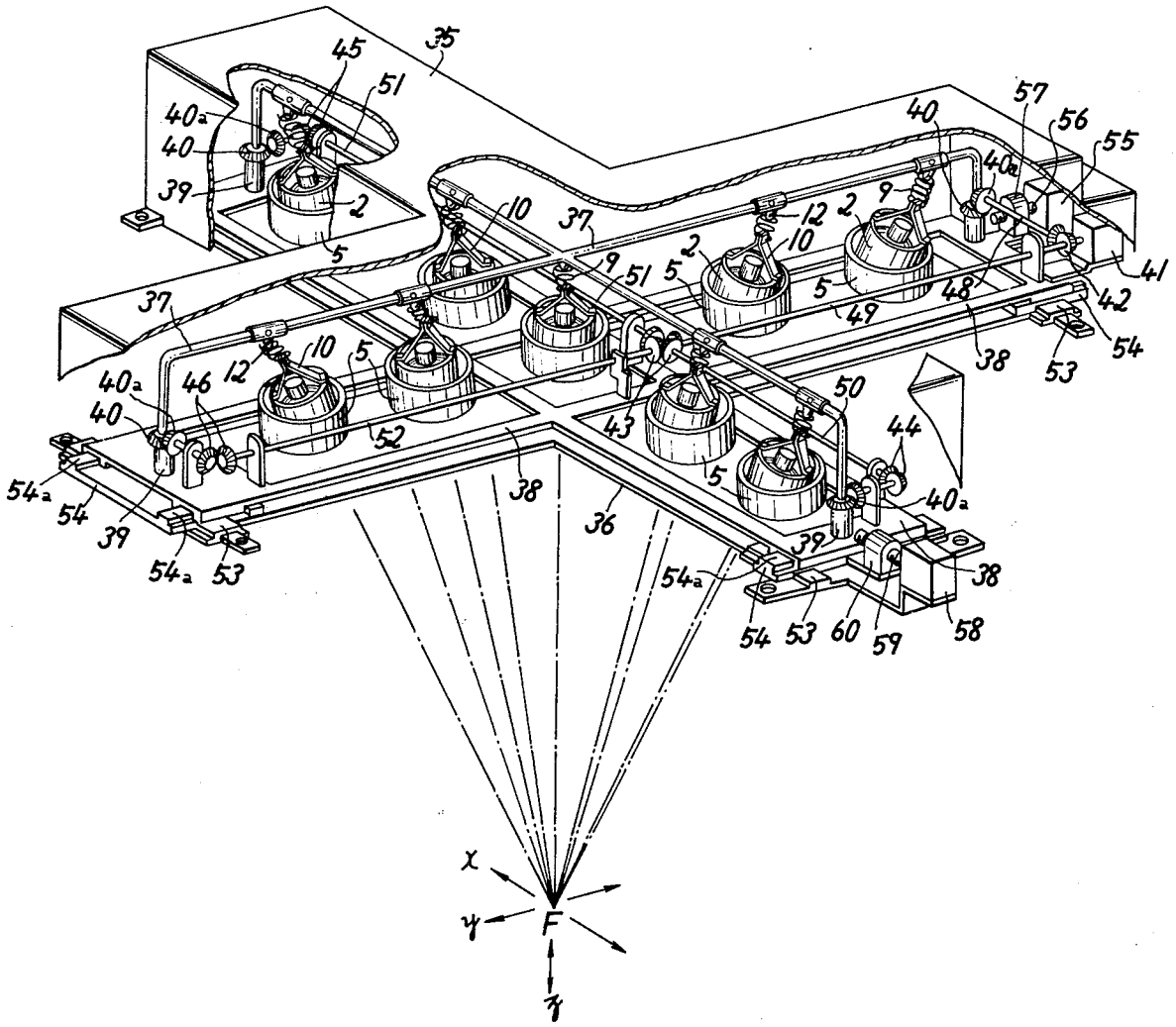
Figure 8:
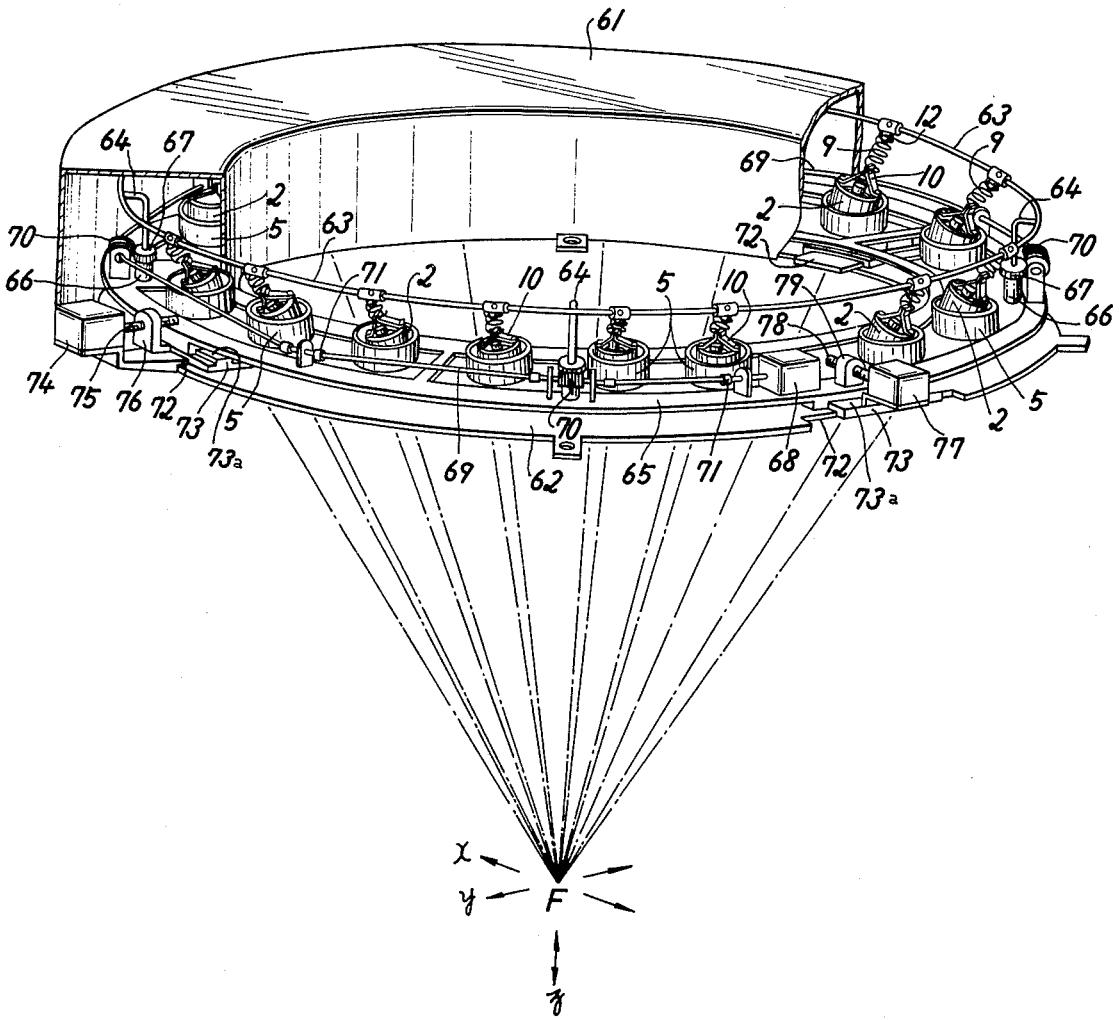
Figure 9:
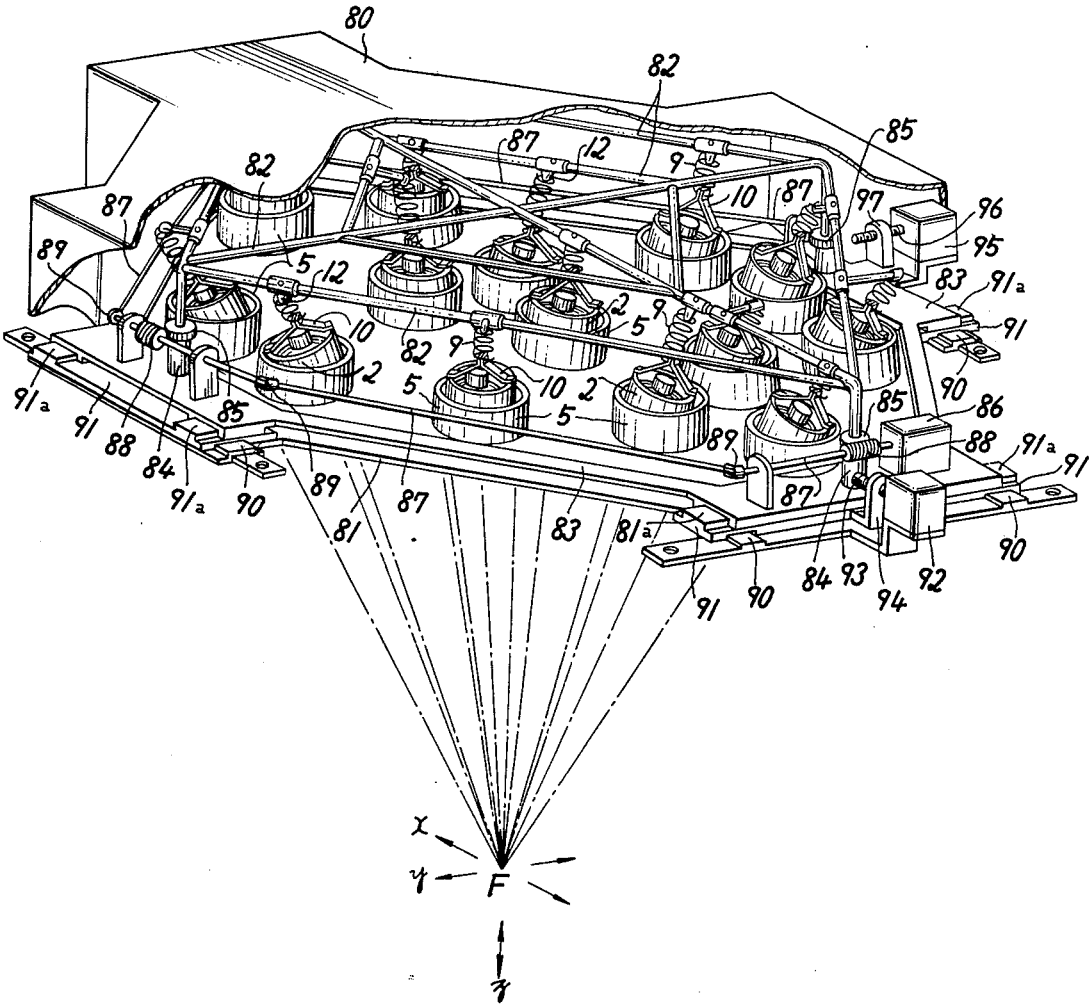

Next an embodiment of the present invention based on this principle is illustrated in FIG. 5, where there is no limitation to the number of lamps to be used and the structure of the lamp is the same.

Thus, a cylindrical lamp housing 2 is fitted on the plane $P_1$ below the front board 1 of the lamp assembly in a stationary illuminating fixture, freely tiltable in the longitudinal and the vertical direction in such a manner that the center O of the lamp L may fall within the plane $P_1$ which is parallel to the front board 1.

At the bottom of the lamp housing 2 an infrared absorption filter 3 is provided, while at the top of it a reflector 4 is provided to pass the infrared rays in the light of the lamp L and reflect the visible rays back to the bottom. The lamp housing 2 is tiltable around a tilting axis 6 pivotally connected to the lamp housing holder 5 fixed to the front board 1, and around the tilting axis 8 which pivots the lamp housing 2 and a tilting ring 7 located at 90° to tilting axis 6 on the same plane.

To the top of the lamp housing 2 which lies in the central light axis of the lamp L is fixed, via the arm 10, one end of the spring 9, the other end of which is rotatably fitted via the ball joint 12 to the driving rod 11, i.e., the driver for longitudinal (Y-direction) and transverse (X-direction) movement on a plane parallel to the plane $P_1$ and for vertical (Z-direction) movement relative to the plane $P_1$.

The movement in the X-direction, the Y-direction and the Z-direction of this driving rod 11 is accomplished according to the above principle, and it makes no difference whether this movement is automatic or manual.

At the bottom of the lamp housing holder 5 is fitted a semispherically-shaped transparent globe 14 by means of the globe holder 15 using a packing 13, thereby maintaining air tightness between the top and bottom of the front board.

The center O of the lamp L is located on the plane $P_1$ which is below the front board 1 for the purpose of keeping the illuminating light axis invariable with no decrease in the illuminating efficiency by preventing the effective range of the illuminating light flux from being reduced by the front board 1 or the globe holder 15, even when the angle of the illuminating light axis of the lamp L is substantially changed.

Comparing the lamp structure with the above-described principle illustrated in FIG. 1, the center O of the lamp L corresponds to O of the principle, the center of the ball joint 12 corresponds to G of the principle and the spring 9 corresponds to K of the principle.

Regardless of the direction in which the driving rod 11 moves, the center of the ball joint 12 and the center O of the lamp L are always aligned.

In the figures, 16 is a cord connecting the lamp L to the power supply.

Various embodiments of the present invention using the above-mentioned lamp structure are to be illustrated in the following, where like symbols designate like elements.

EXAMPLE 1 (FIG. 6)

(A plurality of linear lamp groups arranged parallel in two rows)

The front board 1 of a rectangular case 17 of the illuminating fixture buried in the ceiling is equipped with two parallel rows of a plurality of lamp housings 2 of the same structure as shown in FIG. 5, fitted by means of the lamp housing holder 5.

To the arm 10 of each lamp housing 2 is fitted one end of a spring 9, the other end of which is connected to one of a pair of driving rods 11 provided on a plane parallel to the front board 1, inclined at such an angle that the light axis of each lamp L may converge at a position below an arbitrary illuminating focus, using a ball joint 12 for each row.

On an H-shaped X-axis slide base 28 which is slidable in the X-axis direction along guide rails 27 provided at the four corners of the front board 1 is provided a Y-axis slide base 18 which is slidable in the Y-axis direction along the guide rails 28*a*.

Both sides of each driving rod 11 are bent downwardly at 90°. The bottom ends of each rod has screw gears engaged with screw gears in the axial center of bevel gears 20 rotatably fitted to the tops of pipes 19 fixed to the four corners of an H-shaped Y-axis slide base 18, so that they can be raised or lowered within the pipes 19 and the rotating bevel gears 20, thereby displacing the driving rods 11 in the Z-axis direction.

Each bevel gear 20 is rotated by another bevel gear 20*a* which is driven by a Z-axis drive motor 21 installed on the Y-axis slide base 18, via the drive gear 22, the transmission shafts 23, 24, 25, and the bevel gears 26, 26*a* installed respectively on the Y-axis slide base 18.

Y-axis slide base 18 is made to slide in the Y-axis direction by the rotation of the Y-axis drive motor 29 installed at the center of the front board 1, via the male screw 30 fitted to the rotating shaft of motor 29 and via the female screw 31 engaging the male screw 30 and fixed to the Y-axis slide base 18.

X-axis slide base 28 is made to slide in the X-axis direction by the rotation of the X-axis drive motor 32 installed at the end of the front board 1, via the male screw 33 fitted to the rotating shaft of motor 32 and via the screw hole bored into the slide wall of the X-axis slide base 28, male screw 33 fitting into the screw hole.

In the figure, 34 are connecting plates between the driving rods 11.

Thus in this embodiment for the purpose of shifting the illuminating focus F in the X-axis direction, the X-axis drive motor 32 is turned in forward or reverse directions to cause the X-axis slide base 28 to slide in the X-axis direction. Then the illuminating focus F formed by the light axis of the lamp L in each lamp housing 2 connected to one of the driving rods 11 is also shifted along the X-axis on the plane containing focus F.

For the purpose of causing the focus F to shift in the Y-axis direction, the Y-axis drive motor 29 is turned in the forward or reverse directions to make the Y-axis slide base 18 slide in the Y-axis direction. Then the focus F also is moved along the Y-axis on the plane containing focus F.

For the purpose of causing the focus F to shift in the Z-axis direction, the Z-axis drive motor 21 is turned in the forward or reverse directions to make the driving rods 11 raise or lower. Then the focus will be moved in the Z-axis direction containing focus F.

And as explained in the description of the principle illustrated in FIG. 1, the shifting of the focus F can be done without disturbing the focus formed by the light axis of each lamp, that is, without scattering the light field.

EXAMPLE 2 (FIG. 7)

(A plurality of linear lamp groups arranged in a cruciform)

To the front board 36 of a cruciform case 35 of the illuminating fixture buried in the ceiling are attached in a cruciform fashion by means of the lamp housing holders 5 a plurality of lamp housings 2 of the same structure as shown in FIG. 5.

To the arm 10 of each lamp housing 2 is fitted one end of a spring 9, the other end of which is connected by means of a ball joint 12 to the cruciform driving rod 37 installed on a plane parallel to the front board 36, at such an angle that the light axis of each lamp L may converge at an arbitrary illuminating focus F.

Each end of the driving rod 37 is bent downwardly at 90°. Each bottom end of rod 37 has screw gears engaged with screw gears in the axial center of a bevel gear 40 which is rotatably fitted to the top of the pipe 39 fixed to each end of the Y-axis slide base 38 made of a cruciform board. Rotation of bevel gears 40 causes the driving rod 37 to be raised or lowered within the pipes 39, thereby shifting rod 37 in the Z-axis direction.

The Y-axis slide base 38 has an adequate space left at mid-width of the cruciform board which constitutes such base, so that when base 38 is moved, this movement may not be hindered by the lamp housing holders 5.

Each bevel gear 40 is rotated by another bevel gear 40*a* which is rotated by the Z-axis drive motor 41 installed on the Y-axis slide base 38 via the bevel gears 42–46, and the transmission shafts 48–52 respectively provided on the Y-axis slide base 38.

On the X-axis slide base 54 which is slidable in the X-axis direction along the guide rails 53 provided at each end of the front board 36 is fitted the Y-axis slide base 38 so that it can slide in the Y-axis direction along the guide rails 54*a*.

Y-axis slide base 38 is made to slide in the Y-axis direction by the rotation of the Y-axis drive motor 55 installed at one corner of the X-axis slide base 54 in the Y-axis direction, via the male screw 56 fitted to the rotating shaft of motor 55 and via the female screw 57 matching male screw 56 and fixed to the Y-axis slide base 38.

X-axis slide base 54 is made to slide in the X-axis direction by the rotation of the X-axis drive motor 58 installed at one end of the front board 36, via the male screw 59 fitted to the rotating shaft of motor 58 and via the female screw 60 matching male screw 59 and fixed to one side wall of the X-axis slide base 54 in the X-axis direction.

Therefore, for the purpose of shifting the illuminating focus F in the direction of X-, Y- and Z-axes containing focus F, respectively the X-axis drive motor 58, the Y-axis drive motor 55 and the Z-axis drive motor 41 have only to be turned in the forward or reverse directions, the other actions being the same as in Example 1.

EXAMPLE 3 (FIG. 8)

(A plurality of lamps arranged in a ring)

To the front board 62 of a ring case 61 of the illuminating fixture buried in the ceiling are attached in a ring formation by means of the lamp housing holders 5 a plurality of lamp housings 2 of the same structure as shown in FIG. 5.

To the arm 10 of each lamp housing 2 is fitted one end of a spring 9, the other end of which is connected via a ball joint 12 to a ring-shaped driving rod 63 provided on a plane parallel to the front board 62, at such an angle that the light axis of each lamp L may converge at an arbitrary illuminating focus F.

At an appropriate position of the driving rod 63 are fitted several transmission shafts 64 which extend perpendicularly downwardly.

The lower ends of each transmission shaft 64 has screw gears engaged with screw gears in the axial center of the worm wheel 67 fitted rotatably to the top of the pipe 66 fixed to the X-axis slide base 65 made of a ring-shaped board, and the rotation of worm wheels 67 causes the transmission shafts 64 to be raised or lowered within the pipes 66, thereby shifting rod 63 in the Z-axis direction.

The X-axis slide base 65 has an adequate space left at mid-width of the ring board constituting such base, so that the movement of the base may not be hindered by the lamp housing holders 5.

Each worm wheel 67 is rotated by a worm 70 meshing with the worm wheel 67 through the transmission shaft 69, when worm 70 is driven by the Z-axis drive motor 68 installed on the X-axis slide base 65.

The transmission shaft 69, which is formed in a ring of shafts appropriately connected together by universal joints 71, is fitted to the X-axis slide base 65.

Guide rails 72 are formed on the peripheral parts of the front board 62 at the intersections of the X-axis and the Y-axis passing through the ring of the front board 62.

To guide rails 72 is fitted the Y-axis slide base 73 which is slidable in the Y-axis direction. To the guide rail 73*a* formed on the Y-axis slide base 73 is fitted X-axis slide base 65 which is slidable in the X-axis direction.

Y-axis slide base 73 is made to the slide in the Y-axis direction by the rotation of the Y-axis drive motor 74 installed on the peripheral part of the front board 62 where the front board 62 and the Y-axis intersect, via the male screw 75 fitted to the rotating shaft of motor 74 and via the female screw 76 matching the male screw 75 and fixed to the Y-axis slide base 73.

X-axis slide base 65 is made to slide in the X-axis direction by the rotation of the X-axis drive motor 77 installed on the Y-axis slide base 73 where the front board 62 and the X-axis intersect, via the male screw 78 fitted to the rotating shaft of motor 77 and via the female screw 79 matching male screw 78 and fixed to the X-axis slide base 65.

Thus in this embodiment the shifting of the focus F in the directions of the X-, Y- and Z-axes containing focus F can be done by forward or reverse turning of respectively the X-axis drive motor 77, the Y-axis drive motor 74 and the Z-axis drive motor 68, the other actions being the same as in Example 1.

EXAMPLE 4 (FIG. 9)

(A plurality of lamps irregularly arranged)

To the front board 81 of a polygonal case 80 of the illuminating fixture buried in the ceiling are fitted in a desired irregular array by means of the lamp housing holders 5 a plurality of lamp housings 2 of the same structure as shown in FIG. 5.

To the arm 10 of each lamp housing 2 is fitted one end of a spring 9, the other end of which is fitted by means of a ball joint 12 to an irregularly-formed driving rod 82 provided on a plane parallel to the front board 81, at such an angle that the light axis of each lamp L may converge at an arbitrary focus F.

Opposite ends of rod 82, in both the X- and Y- axis directions passing the center of the driving rod 82, are bent downwardly at 90°.

The lower part of each bent end has screw gears engaged with screw gears in the axial center of the worm wheel 85 rotatably fitted to the top of the pipe 84 fixed to the Y-axis slide base 83 in the same ring form as the front board 81, and the rotation of worm wheels 85 causes the driving rod 82 to be raised or lowered within the pipes 84, thereby shifting rod 82 in the Z-axis direction.

Each worm wheel 85 is rotated by a worm 88 meshing with the worm wheel 85 via the transmission shaft 87, when worm 88 is driven by the Z-axis drive motor 86 installed on the Y-axis slide base 83.

The transmission shaft 87, which is formed in a ring of shafts appropriately connected together by universal joints 89, is attached to the Y-axis slide base 83.

Guide rails 90 are formed at each end of the front board 81 which is intersected by the X-axis and the Y-axis passing through the center of polygonal ring front board 81.

To the guide rails 90 is fitted the X-axis slide base 91 which is slidable in the X-axis direction, while to the Y-axis sliding guide rails 91*a* formed on the X-axis slide base 91 is fitted Y-axis slide base 83 which is slidable in the Y-axis direction.

X-axis slide base 91 is made to slide in the X-axis direction by the rotation of the X-axis drive motor 92 installed outside the front board 81 where the front board 81 and the X-axis intersect, via the male screw 93 fitted to the rotating shaft of motor 92 and via the female screw 94 matching male screw 93 and fixed to the X-axis slide base 91.

Y-axis slide base 83 is made to slide in the Y-axis direction by the rotation of the Y-axis drive motor 95 installed on the X-axis slide base 91 where the front board 81 and the Y-axis intersect, via the male screw 96 fitted to the rotating shaft of motor 95 and via the female screw 97 matching male screw 96 and fixed to the Y-axis slide base 83.

Thus, in this embodiment the shifting of the focus F in the directions of the X-, Y- and Z-axes containing the focus F can be done by forward or reverse turning of respectively the X-axis drive motor 92, the Y-axis drive motor 95 and the Z-axis drive motor 86, the other actions being the same as in Example 1.

Whereas in the embodiments illustrated above the angle of the light axis in a number of lamps fixed in position is changed by moving the driving rod in the directions of the X-, Y- and Z-axes, it is obvious that the same effect of changing the focus as in such embodiments may be attained by moving the lamps in the directions of the X-, Y- and Z-axes with the driving rod fixed in position.

Also, the driving rod, which is illustrated as a rod, may be a single plate of appropriate size.

Many lamps illustrated in the above are all located on the same horizontal plane, but the plane upon which to arrange the lamps may be a curved one or a bent one. It is self-evident that the plane may be modified in any shape or structure, so long as the above principle is satisfied.

Using the illuminating fixture illustrated in the above examples, the foci of all lamps in well-set condition can be changed to any horizontal direction and depth of the surface to be illuminated of an operating table by merely switching on or off the drive motors for the X-, Y- and Z-axes without touching any lamp case or other illuminating device.

The illuminating fixture of the present invention can be provided within a narrow space of the ceiling above the operating table without making any major modification of the room. Since the illuminating fixture is moved within the ceiling space instead of through the room, there is no possibility of the dust collecting on or adhering to the fixture falling on the operating table. Besides, the illuminating fixture of the present invention, which gives high availability of space, permits an increased number of lamps to be provided, thereby assuring the desired luminous intensity.

Moreover, when the driver and the lamp assembly are connected by an elastic material such as a spring, the illuminating fixture can be free from the adverse effect of external vibration or from aging through long use; can perform all the time as it should; can have the lamp angle conveniently varied to facilitate lamp replacement or repair of the light source; and can permit the lamp to revert to its original position by merely releasing it from the hand after the work is finished. Thus it is extremely convenient for maintenance, inspection and repair.

What is claimed is:

1. In a clinical illumination system of the type including a ceiling positioned above an area to be illuminated and a lighting device positioned within said ceiling, the improvement comprising:

a lamp casing fixedly positioned within said ceiling;

a plurality of lamps tiltably mounted within said lamp casing such that the light axes converge at a focus located in a first plane at a desired depth from said lamps;

a lamp driver device mounted for movement in a second plane parallel to said first plane and for movement perpendicularly to said first and second planes;

means, connecting each of said lamps to said lamp driver device, for aligning said lamps such that said axes thereof are aligned to converge at said focus, said aligning means comprising a plurality of springs, one each coupled to one of said lamps and to said lamp driver device; and means, operatively connected to said lamp driver device, for selectively moving said lamp driver device within said second plane and/or perpendicularly to said second plane, and for thereby moving said focus within said first plane and/or perpendicularly to said first plane.

2. The improvement claimed in claim 1, wherein said lamps are all positioned in a third plane parallel to said first plane.

3. The improvement claimed in claim 2, wherein said lamps are arranged within said third plane in at least two parallel rows.

4. The improvement claimed in claim 2, wherein said lamps are arranged within said third plane in two perpendicular intersecting rows.

5. The improvement claimed in claim 2, wherein said lamps are arranged within said third plane in a ring formation.

6. The improvement claimed in claim 2, wherein said lamps are arranged within said third plane in an irregular pattern.

7. The improvement claimed in claim 11, wherein said aligning means further comprises a ball joint joining each said spring to said lamp driver device.

8. The improvement claimed in claim 1, wherein said moving means comprises a prime mover operatively connected to said lamp driver device.

9. The improvement claimed in claim 1, wherein said casing is airtightly positioned within said ceiling.

10. The improvement claimed in claim 1, wherein said lamp driver device is positioned above said lamps within said casing.

11. The improvement claimed in claim 10, wherein said moving means is positioned within said casing.

* * * * *